US007416391B2

(12) United States Patent
Veltre et al.

(10) Patent No.: US 7,416,391 B2
(45) Date of Patent: Aug. 26, 2008

(54) BUCKET PLATFORM COOLING CIRCUIT AND METHOD

(75) Inventors: Louis Veltre, Simpsonville, SC (US); Christopher Arda Macarian, Coral Springs, FL (US)

(73) Assignee: General Electric Company, Schenectady, NY (US)

( * ) Notice: Subject to any disclaimer, the term of this patent is extended or adjusted under 35 U.S.C. 154(b) by 202 days.

(21) Appl. No.: 11/360,769

(22) Filed: Feb. 24, 2006

(65) Prior Publication Data

US 2007/0201979 A1 Aug. 30, 2007

(51) Int. Cl.
*F01D 5/18* (2006.01)

(52) U.S. Cl. ..... 416/97 R; 416/193 A

(58) Field of Classification Search ..... 416/193 A
See application file for complete search history.

(56) References Cited

U.S. PATENT DOCUMENTS

| | | | | |
|---|---|---|---|---|
| 5,382,135 | A | 1/1995 | Green | |
| 5,536,143 | A | 7/1996 | Jacala et al. | |
| 5,639,216 | A | 6/1997 | McLaurin et al. | |
| 5,813,835 | A * | 9/1998 | Corsmeier et al. | 416/97 R |
| 5,848,876 | A | 12/1998 | Tomita | |
| 6,019,579 | A | 2/2000 | Fukuno et al. | |
| 6,071,075 | A | 6/2000 | Tomita et al. | |
| 6,120,249 | A | 9/2000 | Hultgren et al. | |
| 6,132,173 | A | 10/2000 | Tomita et al. | |
| 6,190,130 | B1 * | 2/2001 | Fukue et al. | 416/97 R |
| 6,196,799 | B1 | 3/2001 | Fukue et al. | |
| 6,309,175 | B1 | 10/2001 | Hahnle et al. | |
| 6,390,774 | B1 | 5/2002 | Lewis et al. | |
| 6,416,284 | B1 | 7/2002 | Demers et al. | |
| 6,422,817 | B1 | 7/2002 | Jacala | |
| 6,431,833 | B2 | 8/2002 | Jones | |
| 6,481,967 | B2 | 11/2002 | Tomita et al. | |
| 6,506,020 | B2 | 1/2003 | Dailey | |
| 6,641,360 | B2 | 11/2003 | Beeck et al. | |
| 6,805,534 | B1 | 10/2004 | Brittingham | |
| 2006/0269409 | A1 * | 11/2006 | Torii et al. | 416/97 R |

FOREIGN PATENT DOCUMENTS

| | | |
|---|---|---|
| EP | 0 789 806 | 7/1998 |
| EP | 0 777 818 | 10/1998 |
| EP | 0 937 863 | 4/2000 |
| EP | 0 866 214 | 6/2003 |
| EP | 1 087 102 | 1/2004 |
| EP | 1 514 999 | 3/2005 |
| JP | 10252406 | 9/1998 |
| JP | 2001090501 | 4/2001 |

OTHER PUBLICATIONS

U.S. Appl. No. 11/282,704, filed Nov. 21, 2005.

* cited by examiner

*Primary Examiner*—Richard Edgar
(74) *Attorney, Agent, or Firm*—Nixon & Vanderhye PC

(57) ABSTRACT

In a turbine bucket having an airfoil portion and a root portion with a platform at an interface between the airfoil portion and the root portion, a platform cooling arrangement including: a cooling passage defined in the platform to extend along at least a portion of a concave, pressure side of the airfoil portion, at least one cooling medium inlet to said cooling passage extending from an airfoil cooling medium cavity in a vicinity of an axial center of the airfoil portion, and at least one outlet opening for expelling cooling medium from said cooling passage.

6 Claims, 9 Drawing Sheets

BUCKET PLATFORM COOLING CIRCUIT AND METHOD

BACKGROUND OF THE INVENTION

The present invention relates to a novel cooling system for increasing the useful life of a turbine bucket.

A gas turbine has (i) a compressor section for producing compressed air, (ii) a combustion section for heating a first portion of said compressed air, thereby producing a hot compressed gas, and (iii) a turbine section having a rotor disposed therein for expanding the hot compressed gas. The rotor is comprised of a plurality of circumferentially disposed turbine buckets.

Referring to FIG. 1, each turbine bucket 10 is comprised of an airfoil portion 12 having a suction surface and a pressure surface; and a root portion 14 having structure 18 to affixing the blade to the rotor shaft, a platform 16 from which said airfoil extends, and a shank portion 20.

The platforms are employed on turbine buckets to form the inner flow path boundary through the hot gas path section of the gas turbine. Design conditions, that is gas path temperatures and mechanical loads, often create considerable difficulty to have bucket platforms last the desired amount of time in the engine. In this regard, the loading created by gas turbine buckets create highly stressed regions of the bucket platform that, when coupled with the elevated temperatures, may fail prior to the desired design life.

A variety of previous platform cooling designs have been used or disclosed. Referring to FIG. 2, one previous platform cooling design was based on utilizing the cavity 122 formed by adjacent bucket shanks 120 and platforms 116 as an integral part of the cooling circuit. This type of design extracts air from one of the buckets internal cooling passages and uses it to pressurize the cavity 122 formed by the adjacent bucket shanks 120 and platforms 116 described above. Once pressurized, this cavity can then supply cooling to almost any location on the platform. Impingement cooling is often incorporated in this type of design to enhance heat transfer. The cooling air may exit the cavity through film cooling holes in the platform or through axial cooling holes which then direct the air out of the shank cavity. This design, however, has several disadvantages. First, the cooling circuit is not self contained in one part and is only formed once at least two buckets 110 are assembled in close proximity. This adds a great degree of difficulty to pre-installation flow testing. A second disadvantage is the integrity of the cavity 122 formed between adjacent buckets 110 is dependent on how well the perimeter of the cavity is sealed. Inadequate sealing may result in inadequate platform cooling and wasted cooling air.

Another prior art design is disclosed in FIGS. 1(a) and 5(a) of U.S. Pat. No. 6,190,130. This design uses a cooling circuit that is contained fully within a single bucket. With this design, cooling air is extracted from an airfoil leading edge cooling passage and directed aft through the platform. The cooling air exits through exit holes in the aft portion of the bucket platform or into the slash-face cavity between adjacent bucket platforms. This design has an advantage over that described above and depicted in FIG. 2 in that it is not affected by variations in assembly conditions. However, as illustrated therein, only a single circuit is provided on each side of the airfoil and, thus, there is the disadvantage of having limited control the amount of cooling air used at different locations in the platform. This design also has the disadvantage of restricting the cooling air supply to the leading edge cavity.

Yet another prior art cooling circuit configuration is disclosed in FIG. 3(a) of U.S. Pat. No. 6,190,130 and also in U.S. Pat. No. 5,639,216. This design also uses a cooling circuit fully contained within a single bucket, but it is supplied by air from underneath the platform, i.e. shank pocket cavity or forward wheel space (disc cavity).

BRIEF DESCRIPTION OF THE INVENTION

The invention proposes a platform geometry designed to reduce both stress and temperature in the bucket platform.

Thus, the invention may be embodied in a turbine bucket having an airfoil portion, a root portion with a platform at an interface between the airfoil portion and the root portion, and a platform cooling arrangement including: a cooling passage defined in the platform to extend along at least a portion of a concave, pressure side of the airfoil portion, at least one cooling medium inlet to said cooling passage extending from an airfoil cooling medium cavity in a vicinity of an axial center of the airfoil portion, and at least one outlet opening for expelling cooling medium from said cooling passage.

The invention may also be embodied in a method of cooling a platform of a turbine bucket having an airfoil portion and a root portion, said airfoil portion being joined to the platform and the platform extending over said root portion, comprising: providing a cooling passage at least a portion of a concave, pressure side of the airfoil portion; flowing a cooling medium through a bore from a cooling medium cavity in a vicinity of an axial center of the airfoil portion to said cooling passage; and expelling cooling medium from said cooling passage through at least one outlet opening.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

According to an example embodiment of the invention, one or more preferential cooling passages are defined through the bucket platform on the concave or pressure side of the airfoil as schematically illustrated in FIGS. 3, 6, 7, 8, 9, 10 and 11.

These cooling passages are supplied with a cooling medium, such as air, from the airfoil cooling circuit, more specifically from a vicinity of an axial center or mid-section of the respective airfoil. In the illustrated examples, where plural cooling passages are provided, each is supplied with air from a respective airfoil cooling circuit cavity or passage.

The cooling passages are respectively sized and shaped to accomplish at least two goals. First, the passages are defined to allow for a preferential cooling of the platform. Preferential cooling allows the correct amount of cooling to be performed at various locations on the platform.

Figure 3:
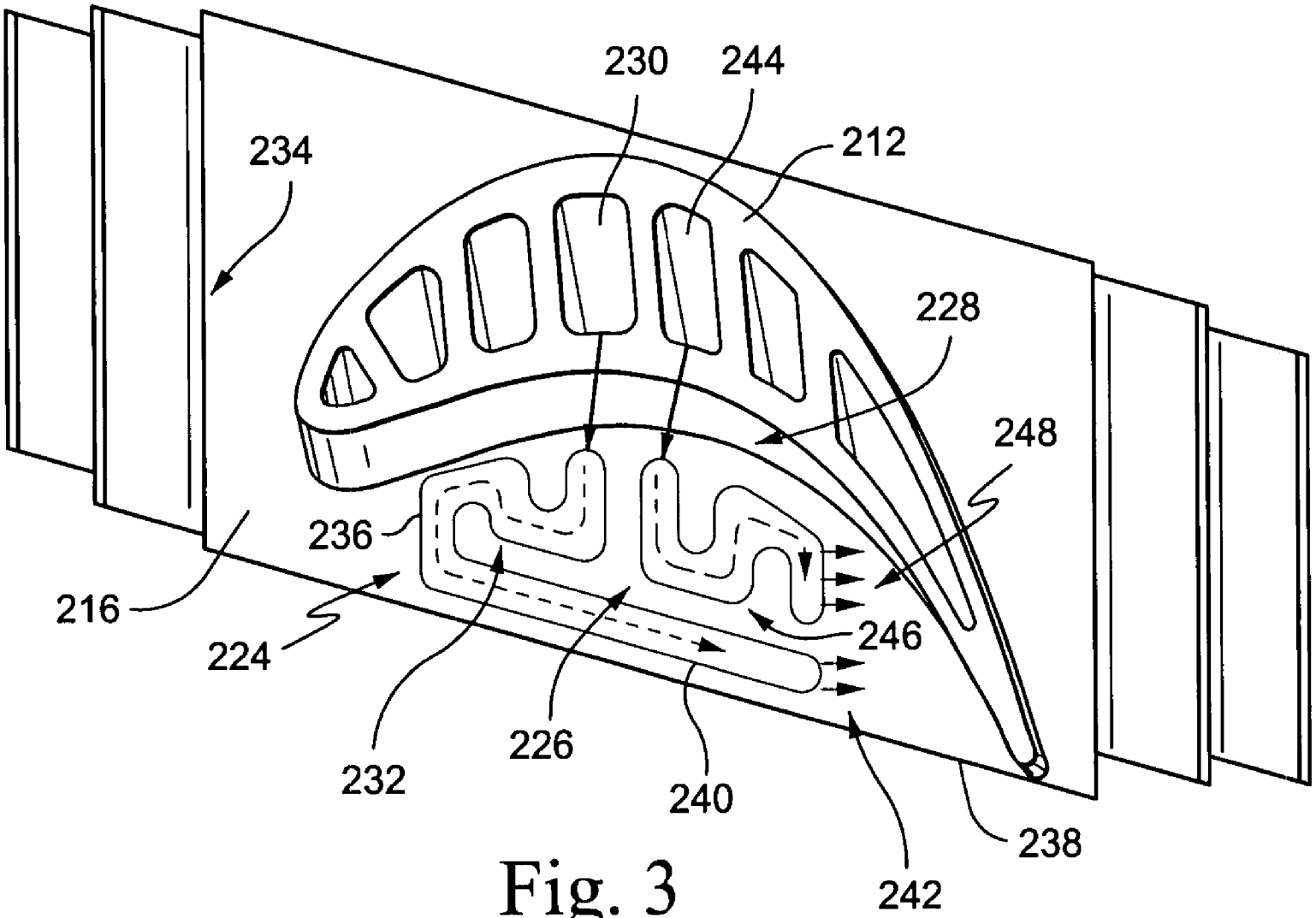
FIG. 3 is a top plan view of a bucket as an example embodiment of the invention.

Referring by way of example to FIG. 3, it can be seen that in this example embodiment, two passages 224, 226 are defined on the concave or pressure side 228 of the airfoil 212. The first cooling passage 224 is in flow communication with a cooling circuit cavity or passage 230 of the airfoil 212 in a vicinity of an axial center or midpoint of the airfoil and is disposed to define a flow passage for cooling air that extends along a first, serpentine path 232 towards a leading edge 234 of the platform 216, then extends along a part circumferential path 236 towards the slash-face 238 on the pressure side of the airfoil, and then finally extends along a substantially straight side cooling path 240 extending generally parallel to the slash-face 238 towards the trailing edge of the platform 216. In the illustrated example embodiment, the first cooling passage 224 terminates axially in a plurality of film cooling holes 242 to discharge the cooling medium, such as air, onto the flow path surface of the platform, providing even further cooling benefit.

In the embodiment of FIG. 3, a second cooling passage 226 is also provided on the concave, pressure side 228 of the airfoil 212 and is disposed to be in flow communication with a cooling air cavity 244, again in the vicinity of the axial center or midpoint of the airfoil 212. The second cooling passage 226 extends along a serpentine path 246 towards the aft or trailing edge of the platform 216. In the illustrated example embodiment, the second cooling flow passage also terminates axially in a plurality of film cooling holes 248. The serpentine paths 232, 246 in this example embodiment each include a plurality of part circumferential portions interconnected with part axial portions for distributing cooling medium through the platform for preferential cooling purposes. In this regard, as will be understood, by selecting a cooling air supply passage diameter and dimensions of the respective flow passages, differential mass flows and velocities can be achieved for preferential cooling of the respective portions of the platform.

Figure 1:
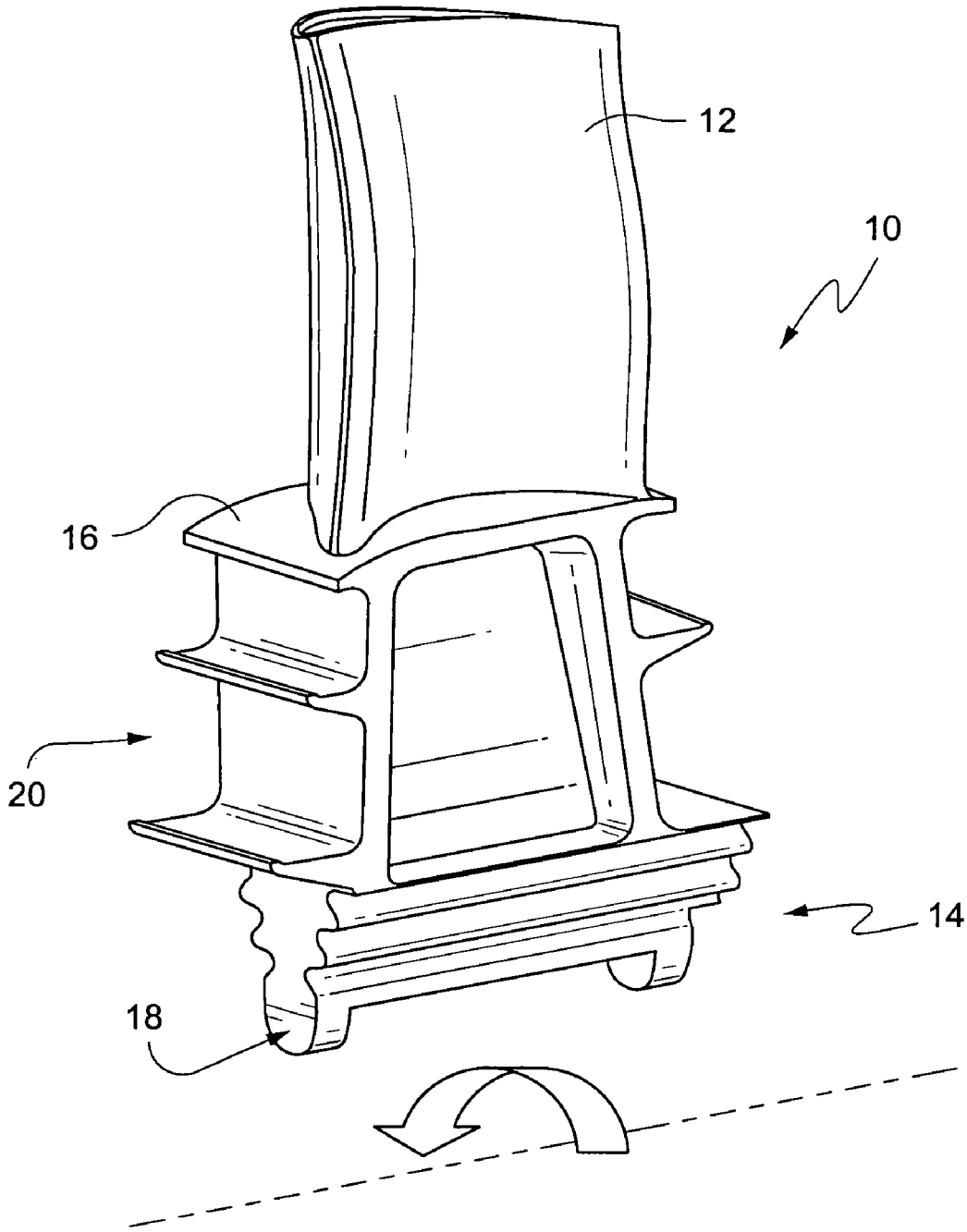
FIG. 1 is a schematic perspective view of a turbine bucket and platform.
Figure 2:
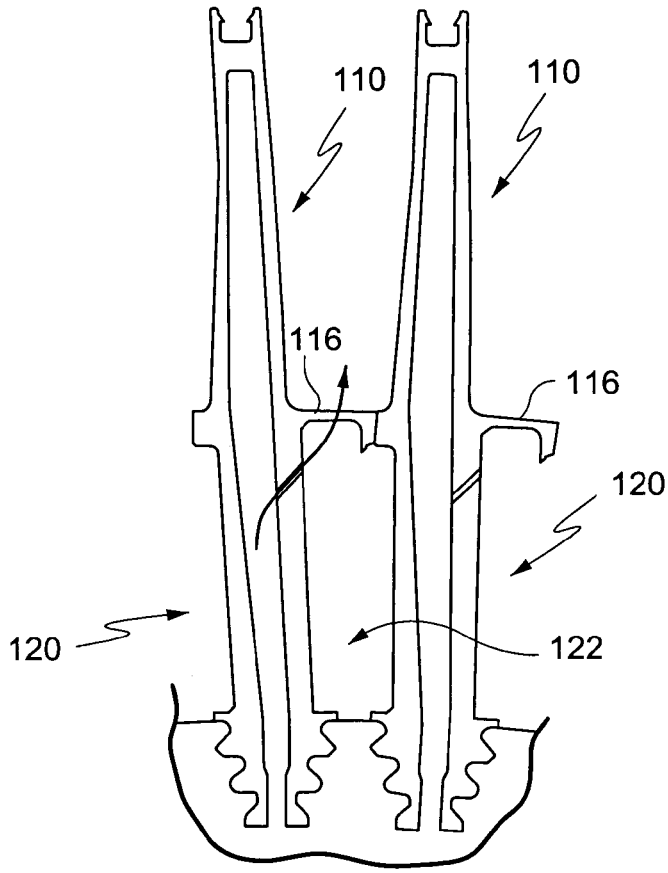
Fig. 2 (PRIOR ART)
FIG. 2 is a schematic illustration of a prior art cooling circuit using a cavity between adjacent bucket shanks.
Figure 4:
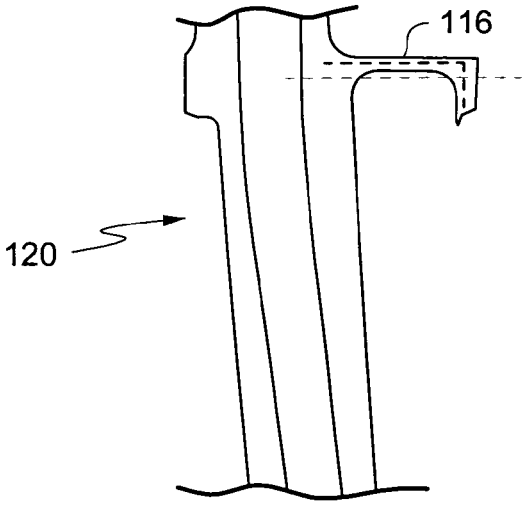
Fig. 4 (PRIOR ART)
FIG. 4 is a schematic cross-sectional view of a conventional platform structure.
Figure 5:
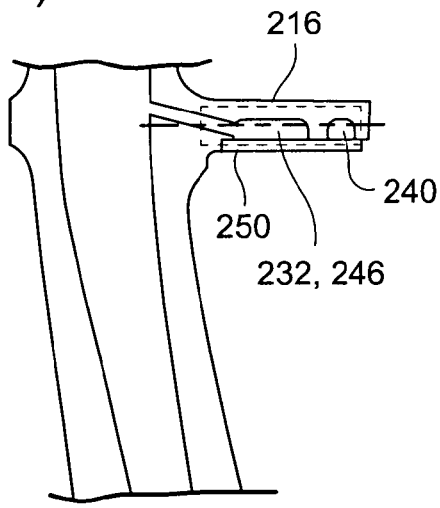
FIG. 5 is a schematic cross-sectional view of a platform design according to an example embodiment of the invention.

Referring to FIGS. 4 and 5, in an example embodiment of the invention, in addition to providing first and second passages for preferential cooling of the platform, the platform is configured so as to have a high stiffness to weight ratio. In this regard, referring to FIG. 4, a conventional platform 116 having for example a "L" shaped cross-section requires a large thickness to be stiff about the bending axis. In an example embodiment of the invention, as illustrated in FIG. 5, the paths 232, 246, 240 of the cooling passages 224, 226 are defined by casting the platform so as to define grooves on the radially inner surface of the platform 216 and providing a bottom plate 250, to define a bottom of the respective cooling passages 224, 226 and complete the platform structure 216. The resulting "box" section is inherently stiffer than a conventional "L" section, whereas the weight is minimized by the material omitted to define the internal passages. Thus, in addition to the increased cooling effect as mentioned above, the stiffness and thus strength of the platform is increased while minimizing the weight thereof. Furthermore, the platform structure is simplified and production of passages having a desired configuration is facilitated.

Figure 6:
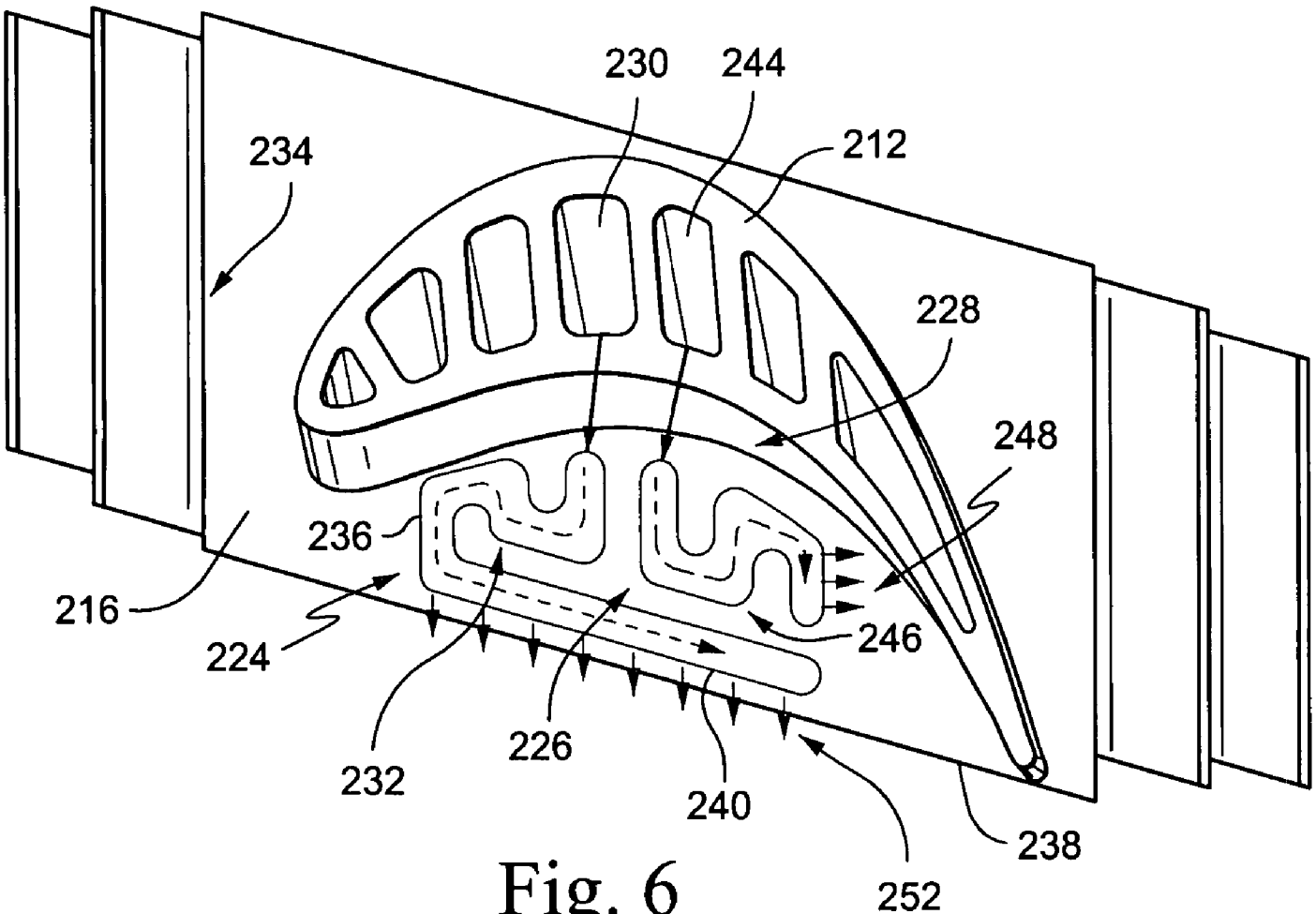
FIG. 6 is a top plan view of a bucket according to a modification of the embodiment of FIG. 3.

Another example embodiment of the invention is illustrated in FIG. 6. As illustrated therein, the first and second cooling passages generally correspond to those as illustrated in FIG. 3 except that the first cooling passage 224 in this embodiment has exit holes 252 to the slash-face 238. Providing exit holes in the slash-face provides additional cooling and increases the part's ability to resist hot gas ingestion. In the illustrated example, the slash-face exit holes 252 are provided in lieu of film cooling holes 242, although is it to be understood that a combination of slash-face exit holes and film cooling holes could be provided.

Figure 7:
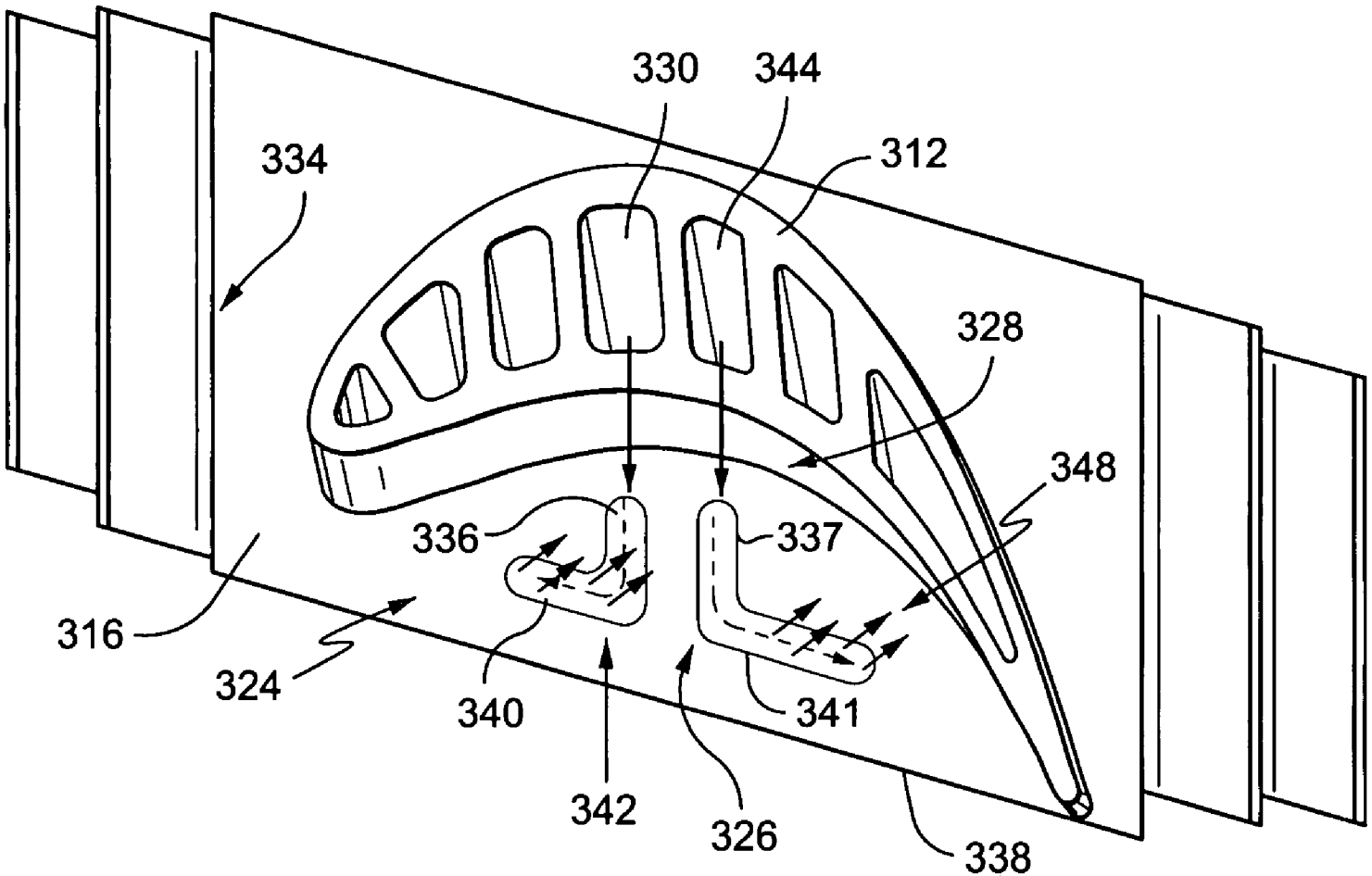
FIG. 7 is a top plan view of a bucket according to a another example embodiment of the invention.

A further example embodiment of the invention is illustrated in FIG. 7. It can be seen that in this example embodiment, two passages 324, 326 are defined on the concave or pressure side 328 of the airfoil 312. The first cooling passage 324 is in flow communication with a cooling circuit cavity or passage 330 of the airfoil 312 in a vicinity of an axial center or midpoint of the airfoil and is disposed to define a flow passage for cooling air that extends along a first, part circumferential path 336 towards slash-face 338 on the pressure side of the airfoil and then extends along a substantially straight side cooling path 340 extending generally parallel to the slash-face 338 towards the leading edge 334 of the platform 316. In the illustrated example embodiment, a plurality of film cooling holes 342 are defined to discharge the cooling medium, such as air, from the first cooling passage 324 onto the flow path surface of the platform, providing even further cooling benefit.

In the embodiment of FIG. 7, a second cooling passage 326 is also provided on the concave, pressure side 328 of the airfoil 312 and is disposed to be in flow communication with a cooling air cavity or passage 344, again in the vicinity of the axial center or midpoint of the airfoil 312. The second cooling passage 326 is a substantial mirror image of the first cooling passage 324, having a first, part circumferential path 337 towards slash-face 338 and having a substantially straight side cooling path 341 extending generally parallel to the slash-face 338 towards the trailing end of the platform 316. In the illustrated example embodiment, the second cooling flow passage also terminates in a plurality of film cooling holes 348. Again, as will be understood, by selecting a cooling air supply passage diameter and dimensions of the respective flow passages, differential mass flows and velocities can be achieved for preferential cooling of the respective portions of the platform.

Figure 8:
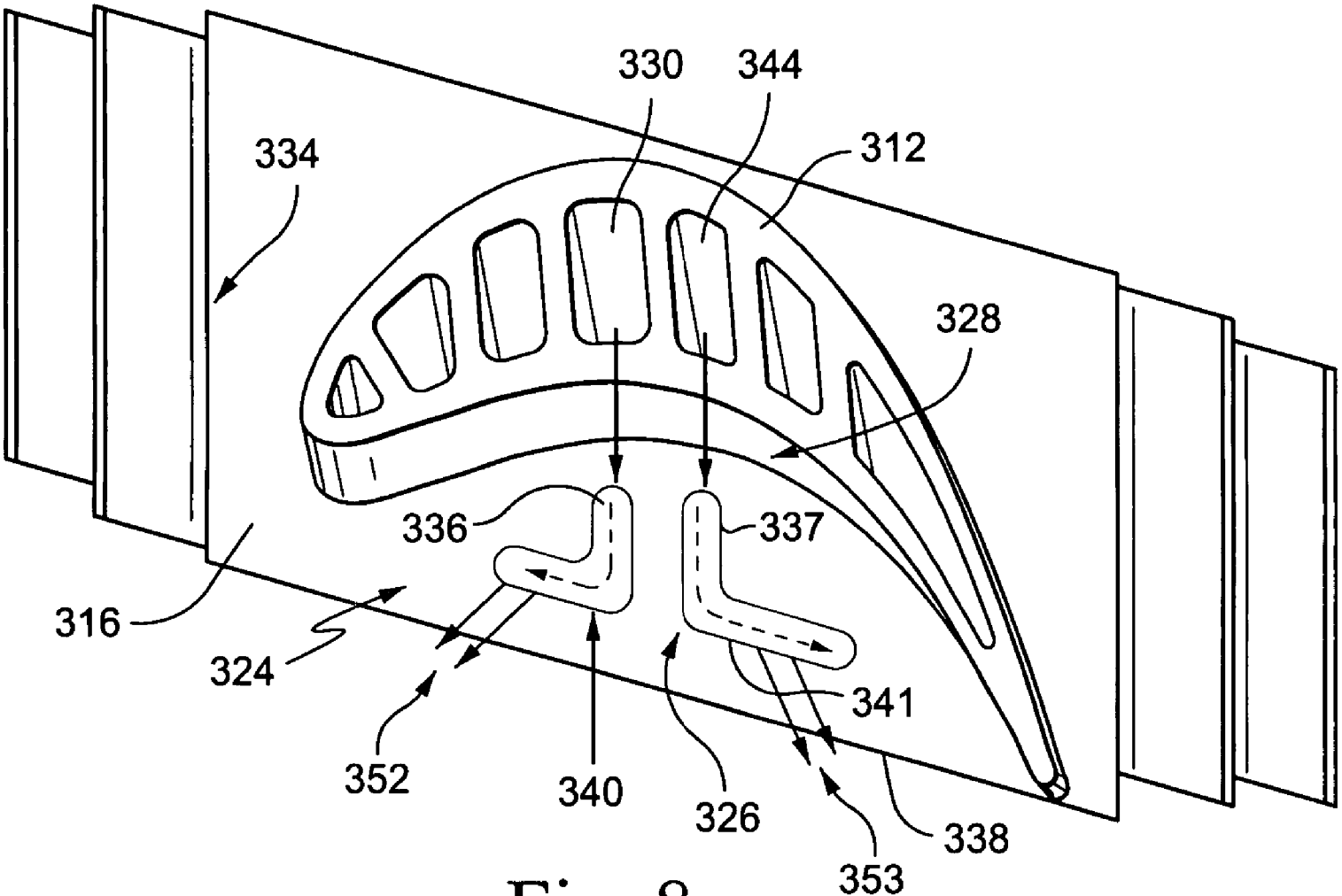
FIG. 8 is a top plan view of a bucket according to a modification of the embodiment of FIG. 7.

Yet another example embodiment of the invention is illustrated in FIG. 8. In this embodiment the first and second cooling passages generally correspond to those as illustrated in FIG. 7 except that the cooling passages in this embodiment have exit holes 352, 353 to the slash-face 338. Providing exit holes in the slash-face provides additional cooling and increases the part's ability to resist hot gas ingestion. In the illustrated example, the slash-face exit holes 352, 353 are provided in lieu of film cooling holes 342, 348 although is it to be understood that a combination of slash-face exit holes and film cooling holes could be provided.

Figure 9:
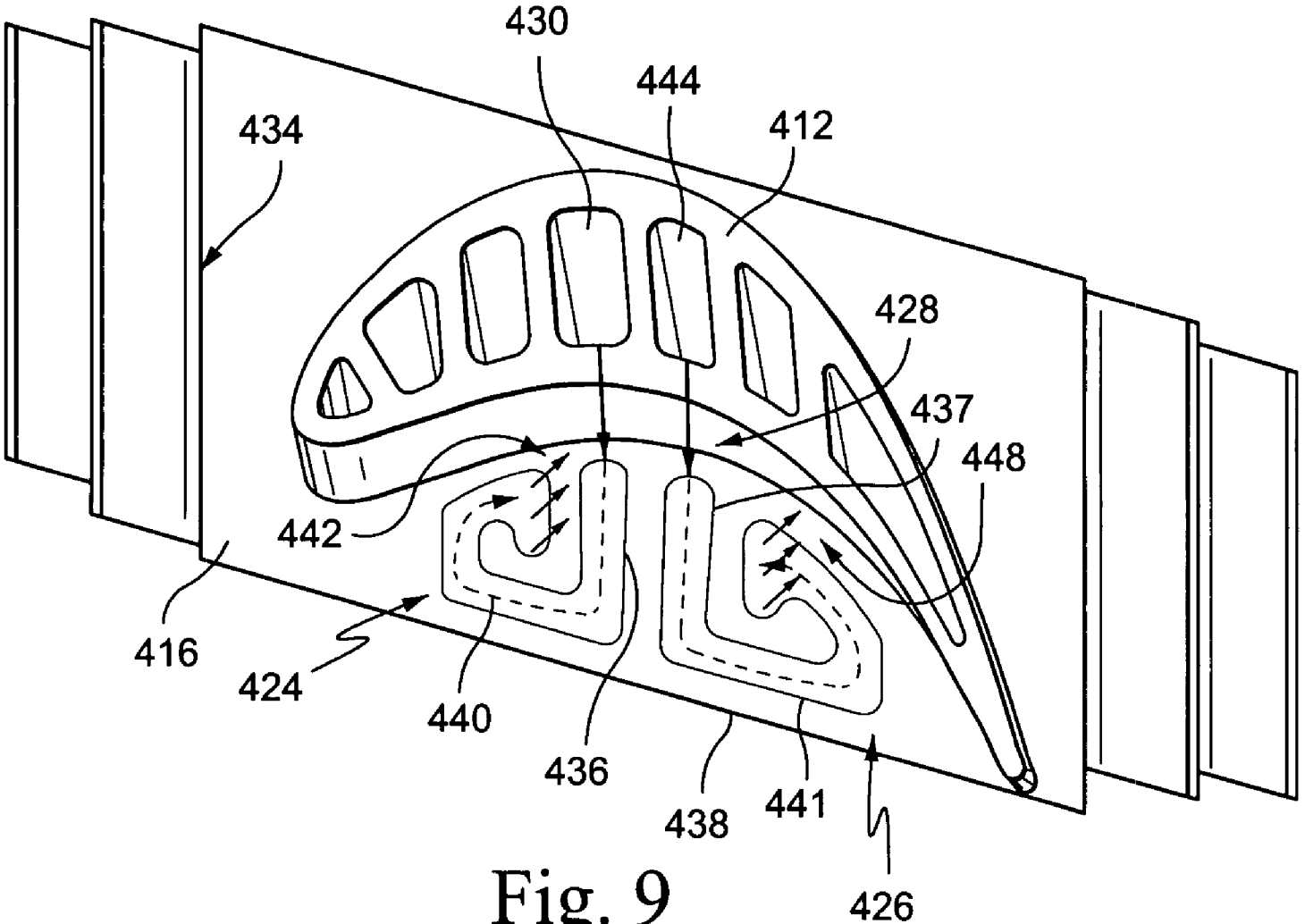
FIG. 9 is a top plan view of a bucket according to a further example embodiment of the invention.

A further example embodiment of the invention is illustrated in FIG. 9. It can be seen that in this example embodiment, two passages 424, 426 are defined on the concave or pressure side 428 of the airfoil 412. The first cooling passage 424 is in flow communication with a cooling circuit cavity or passage 430 of the airfoil 412 in a vicinity of an axial center or midpoint of the airfoil and is disposed to define a flow passage for cooling air that extends along a first, part circumferential path 436 towards slash-face 438 on the pressure side of the airfoil and then extends along a substantially straight side cooling path 440 extending generally parallel to the slash-face 438 towards the leading edge 434 of the platform 416. The flow passage for the cooling air then hooks back towards and along a part of the airfoil 412. In the illustrated example embodiment, a plurality of film cooling holes 442 are defined to discharge the cooling medium, such as air, from the first cooling passage 324 onto the flow path surface of the platform, providing even further cooling benefit.

In the embodiment of FIG. 9, a second cooling passage 426 is also provided on the concave, pressure side 428 of the airfoil 412 and is disposed to be in flow communication with a cooling air cavity or passage 444, again in the vicinity of the axial center or midpoint of the airfoil 412. The second cooling passage 426 is a substantial mirror image of the first cooling passage 424, having a first, part circumferential path 437 extending towards slash-face 438 and having a substantially straight side cooling path 441 extending generally parallel to the slash-face 438 towards the trailing end of the platform 416. The second cooling passage then hooks back towards and along a part of the airfoil 412. In the illustrated example embodiment, the second cooling flow passage also terminates in a plurality of film cooling holes 448. Again, as will be understood, by selecting a cooling air supply passage diameter and dimensions of the respective flow passages, differential mass flows and velocities can be achieved for preferential cooling of the respective portions of the platform.

Figure 10:
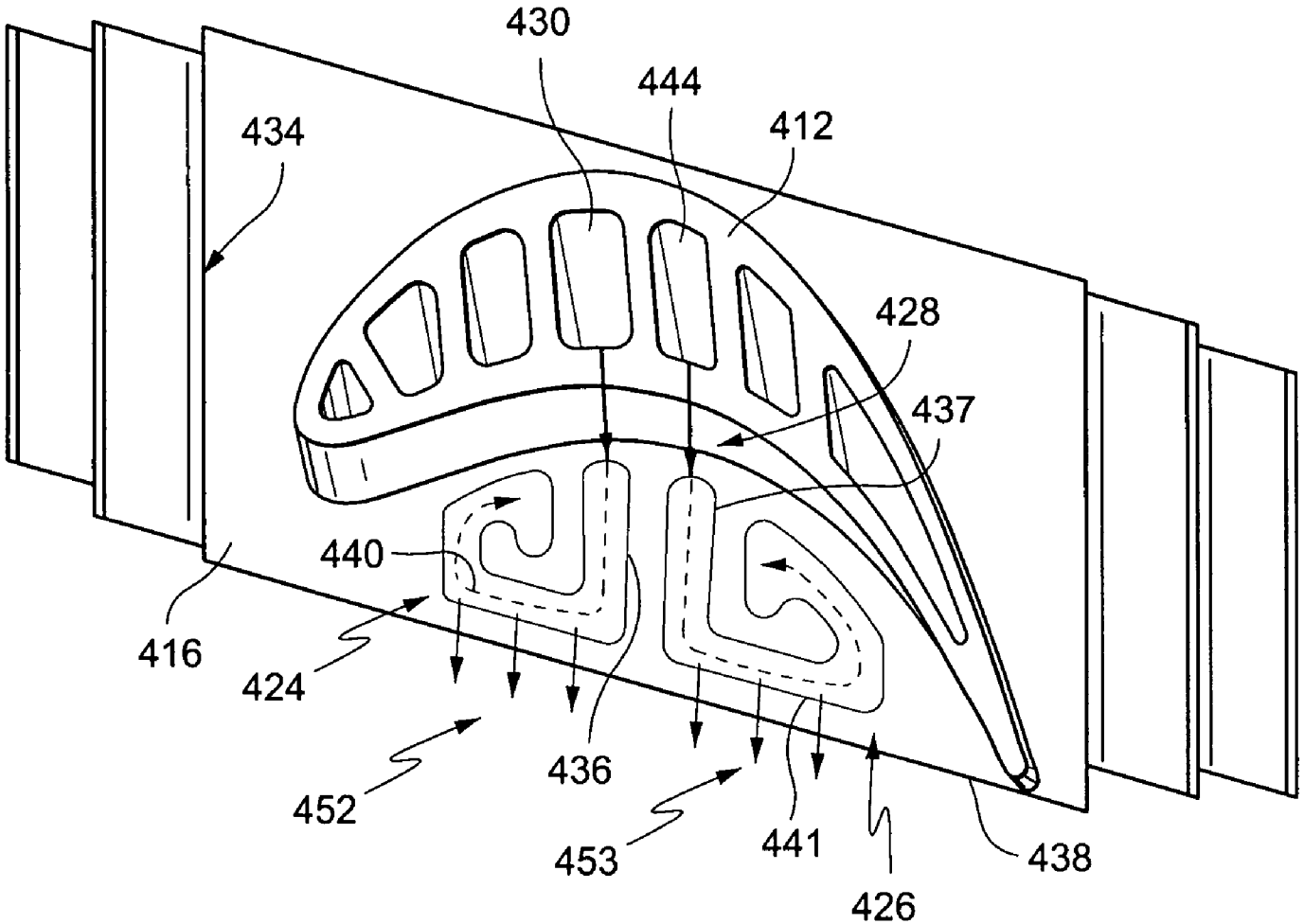
FIG. 10 is a top plan view of a bucket according to a modification of the embodiment of FIG. 9.

Yet another example embodiment of the invention is illustrated in FIG. 10. In this embodiment the first and second cooling passages generally correspond to those as illustrated in FIG. 9 except that the cooling passages in this embodiment have exit holes 452, 453 to the slash-face 438. Providing exit holes in the slash-face provides additional cooling and increases the part's ability to resist hot gas ingestion. In the illustrated example, the slash-face exit holes 452, 453 are provided in lieu of film cooling holes 442, 448, although is it to be understood that a combination of slash-face exit holes and film cooling holes could be provided.

Figure 11:
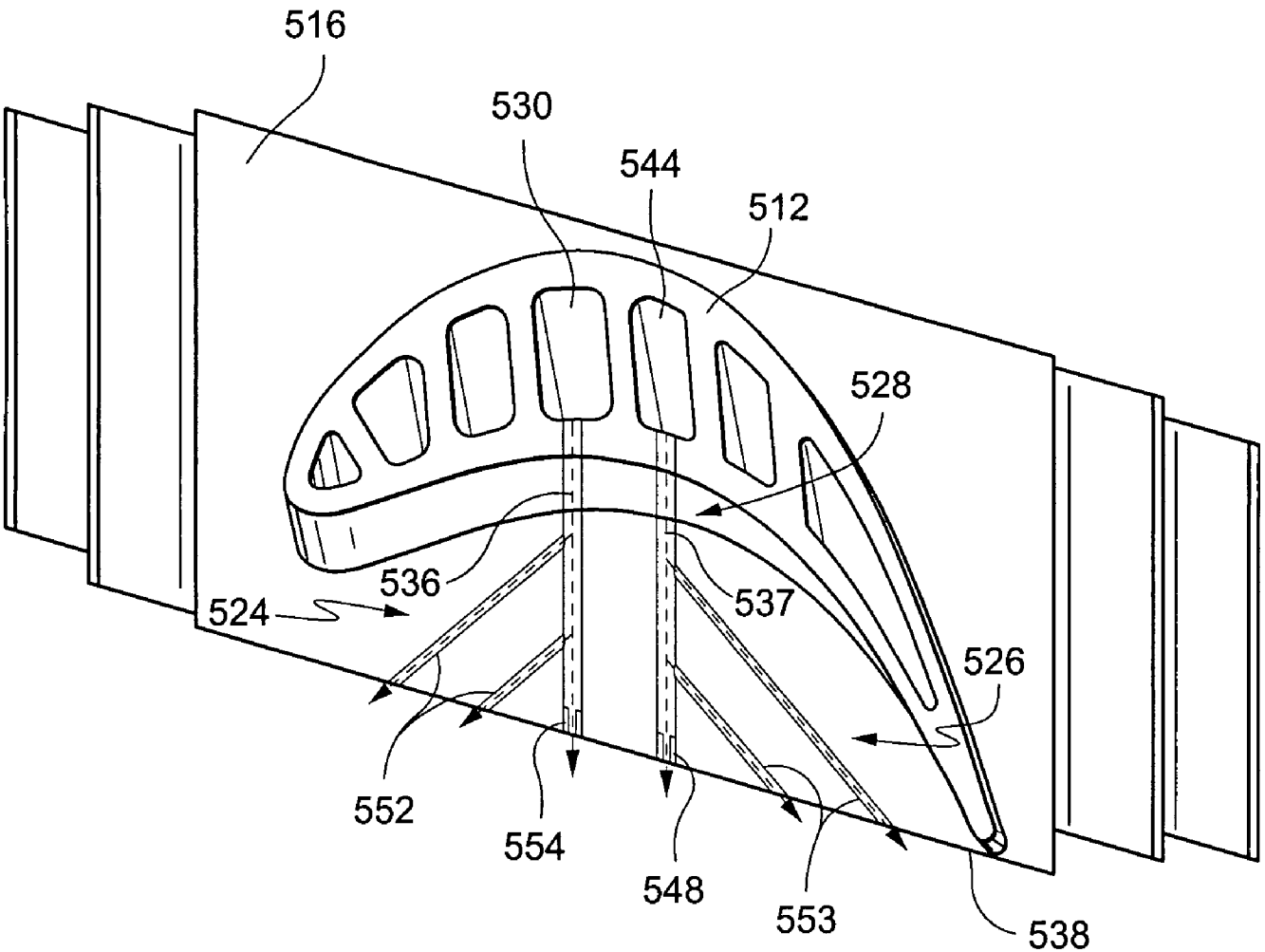
FIG. 11 is a top plan view of a bucket according to a yet another example embodiment of the invention.

Yet a further example embodiment of the invention is illustrated in FIG. 11. It can be seen that in this example embodiment, two passages 524, 526 are defined on the concave or pressure side 528 of the airfoil 512. The first cooling passage 524 is in flow communication with a cooling circuit cavity or passage 530 of the airfoil 512 in a vicinity of an axial center or midpoint of the airfoil and is disposed to define a flow passage for cooling air that extends along a first, part circumferential main supply path 536 to the slash-face 538 on the pressure side of the airfoil. In the illustrated example embodiment, the main supply passage 536 terminates at a metering hole 554 the slash face 538 to control the mass flow level. Further cooling benefit is provided by cooling holes or passages 552 that extend through platform 516, diagonally from the main supply passage 536 of the first cooling passage 524 to the slash face 538. While two cooling holes 552 are illustrated in FIG. 11, it is to be understood that more or fewer such branch passages could be provided for preferentially cooling the platform.

In the embodiment of FIG. 11, a second cooling passage 526 is also provided on the concave, pressure side 528 of the airfoil 512 and is disposed to be in flow communication with a cooling air source 544, again in the vicinity of the axial center or midpoint of the airfoil 512. The second cooling passage 526 is a substantial mirror image of the first cooling passage 524, having a first, part circumferential main supply path 537 extending towards slash-face 538. In the illustrated example embodiment, the second cooling flow passage also terminates in a metering hole 548 at the slash face 538. Further, additional cooling benefit is provided by cooling holes or passages 553 that extend diagonally from the main supply passage 537 to the slash face 538. Again, as will be understood, by selecting a cooling air supply passage diameter and dimensions of the respective flow passages, differential mass flows and velocities can be achieved for preferential cooling of the respective portions of the platform.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a turbine bucket having an airfoil portion, a root portion, and slash-face portions with a platform at an interface between the airfoil portion, root portion, and slash-face portions, a platform cooling arrangement including:

a cooling passage defined in the platform to extend along at least a portion of a concave, pressure side of the airfoil portion, at least one cooling medium inlet to said cooling passage extending from an airfoil cooling medium cavity in a vicinity of an axial center of the airfoil portion, said cooling passage including a first, part circumferential portion extending from said airfoil towards a slash-face of the platform and a second, part axial portion extending from said first portion at an angle thereto, and at least one outlet opening for expelling cooling medium from said cooling passage, each said at least one outlet opening exiting solely through said slash-face, and a second cooling passage defined in the platform to extend along at least a portion of a concave, pressure side of the airfoil portion, at least one cooling medium inlet to said second cooling passage extending from an airfoil cooling medium cavity in a vicinity of an axial center of the airfoil portion, and at least one outlet opening for expelling cooling medium from said cooling passage, each said outlet opening exiting solely through said slash-face.

2. A turbine bucket as in claim 1, wherein each said cooling passage includes a first, part circumferential portion extending from said airfoil towards said slash-face of the platform and a second, part axial portion extending from said first portion at an angle thereto, wherein the second portion of one of said cooling passages extends generally towards a leading edge of said platform, and the second portion of the other of said cooling passages extends generally towards a trailing edge of said platform.

3. A turbine bucket as in claim 1, wherein said second cooling passage is a generally serpentine passage.

4. A method of cooling a platform of a turbine bucket having an airfoil portion, a root portion, and slash-face portions, said airfoil portion being joined to the platform and the platform extending over said root portion towards said slash-face portions, comprising:

providing a cooling passage to extend along at least a portion of a concave, pressure side of the airfoil portion, said cooling passage including a first, part circumferential portion extending from said airfoil towards a slash-face of the platform and a second, part axial portion extending from said first portion at an angle thereto;

flowing a cooling medium through a bore from a cooling medium cavity in a vicinity of an axial center of the airfoil portion to said cooling passage; and expelling cooling medium from said cooling passage through at least one outlet opening, each said outlet opening exiting solely through said slash-face, wherein said providing a cooling passage includes providing a first, part circumferential cooling passage portion extending from said airfoil towards a slash face of the platform and a second, generally linear cooling passage portion extending substantially parallel to said slash face, wherein said providing a cooling passage further comprises providing a second cooling passage to extend along at least a portion of a concave, pressure side of the airfoil portion, and wherein the method further comprises:

flowing a cooling medium through a bore from another cooling medium cavity in a vicinity of an axial center of the airfoil portion to said second cooling passage; and expelling cooling medium from said second cooling passage through at least one outlet opening, each said at least one outlet opening exiting solely through said slash-face.

5. A method as in claim 4, wherein said each said cooling passage includes a first, part circumferential portion extending from said airfoil towards a slash face of the platform and a second, generally linear portion extending substantially parallel to the slash face of the platform, wherein the linear portion of one of said cooling passages extends towards a leading edge of said platform, and the linear portion of the other of said cooling passages extends towards a trailing edge of said platform.

6. In a turbine bucket having an airfoil portion and a root portion with a platform at an interface between the airfoil portion and the root portion, a platform cooling arrangement including:

a cooling passage defined in the platform to extend along at least a portion of a concave, pressure side of the airfoil portion, at least one cooling medium inlet to said cooling passage extending from an airfoil cooling medium cavity in a vicinity of an axial center of the airfoil portion, and at least one outlet opening for expelling cooling medium from said cooling passage, a second cooling passage defined in the platform to extend along at least a portion of the concave, pressure side of the airfoil portion, at least one cooling medium inlet to said second cooling passage extending from an airfoil cooling medium cavity in a vicinity of the axial center of the airfoil portion, and at least one outlet opening for expelling cooling medium from said second cooling passage, wherein each said cooling passage includes a first, part circumferential portion extending from said airfoil towards a slash face of the platform and a second, generally linear portion extending from said first portion at an angle thereto, wherein the linear portion of one of said cooling passages extends generally towards a leading edge of said platform, and the linear portion of the other of said cooling passages extends generally towards a trailing edge of said platform.

* * * * *